US011398682B2

(12) United States Patent
Murray et al.

(10) Patent No.: US 11,398,682 B2
(45) Date of Patent: Jul. 26, 2022

(54) HOSTED, COMPACT, LARGE-APERTURE, MULTI-REFLECTOR ANTENNA SYSTEM DEPLOYABLE WITH HIGH-DISSIPATION FEED

(71) Applicant: LOCKHEED MARTIN CORPORATION, Bethesda, MD (US)

(72) Inventors: Bronson Murray, Littleton, CO (US); Spencer Keith Connor, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 54 days.

(21) Appl. No.: 17/148,474

(22) Filed: Jan. 13, 2021

(65) Prior Publication Data

US 2021/0313684 A1 Oct. 7, 2021

Related U.S. Application Data

(60) Provisional application No. 63/005,135, filed on Apr. 3, 2020.

(51) Int. Cl.

| | |
|---|---|
| ***H01Q 1/28*** | (2006.01) |
| ***H01Q 19/19*** | (2006.01) |
| ***H01Q 1/02*** | (2006.01) |
| ***H01Q 1/08*** | (2006.01) |

(52) U.S. Cl.
CPC ..... *H01Q 19/192* (2013.01); *H01Q 1/02* (2013.01); *H01Q 1/08* (2013.01); *H01Q 1/288* (2013.01)

(58) Field of Classification Search
CPC ..... H01Q 1/02; H01Q 1/08; H01Q 1/288; H01Q 19/192
See application file for complete search history.

(56) References Cited

U.S. PATENT DOCUMENTS

| | | | | |
|---|---|---|---|---|
| 10,862,189 | B1 * | 12/2020 | Romanofsky | H01Q 19/10 |
| 2004/0196203 | A1 * | 10/2004 | Lier | H01Q 21/067 343/824 |
| 2015/0069187 | A1 * | 3/2015 | Mckinnon | B64G 1/503 244/171.8 |

* cited by examiner

*Primary Examiner* — Daniel Munoz
(74) *Attorney, Agent, or Firm* — BakerHostetler

(57) ABSTRACT

A hosted multi-reflector antenna system includes a primary reflector, a subreflector, an aperture, a feed structure and an anti-jam housing. The feed structure includes an electronically steered antenna (ESA). The subreflector directs a reflected beam between a primary reflector and an ESA, and the anti-jam housing encloses the subreflector and the ESA. The antenna system is thermo-elastically decoupled and thermally self-sufficient, accommodates thermal dissipation of the feed structure, and can maintain a precise antenna alignment.

20 Claims, 9 Drawing Sheets

HOSTED, COMPACT, LARGE-APERTURE, MULTI-REFLECTOR ANTENNA SYSTEM DEPLOYABLE WITH HIGH-DISSIPATION FEED

CROSS-REFERENCES TO RELATED APPLICATIONS

This application claims benefit of U.S. Provisional Application No. 63/005,135, filed Apr. 3, 2020, which is incorporated herein by reference in its entirety.

STATEMENT REGARDING FEDERALLY SPONSORED RESEARCH OR DEVELOPMENT

Not Applicable.

FIELD OF THE INVENTION

The present invention generally relates to satellite communication and, more particularly, relates to a hosted, compact, east-west, large-aperture, multi-reflector antenna system deployable with high-dissipation feed.

BACKGROUND

Existing satellite antenna systems are commonly specific to a satellite (bus) design and are not designed to be hosted by other satellite types and/or designs. For example, the mechanical design of the antenna system and the satellite are performed in an integrated design cycle, and the antenna system lacks any payload component, such as an electronically steered antenna (ESA), to be easily hosted. In such an antenna system, antenna pointing can be degraded by the thermal distortions due to lack or insufficiency of thermal management system.

SUMMARY

According to various aspects of the subject technology, methods and systems are disclosed for providing a hosted multi-reflector antenna system. The disclosed hosted multi-reflector antenna system has a number of advantageous features such as compactness, east-west orientation and large aperture, and is deployable with a high-dissipation feed, as further described herein.

In one or more aspects, a hosted multi-reflector antenna system includes a primary reflector, a subreflector, a feed structure and an anti-jam housing. The feed structure includes an electronically steered antenna (ESA). The subreflector directs a reflected beam of the primary reflector onto the ESA, and the anti-jam housing encloses the subreflector and the ESA. The antenna system is mechanically and thermally independent of a host space vehicle, accommodates thermal dissipation of the feed structure, and maintain precise antenna alignment.

In other aspects, a method of providing a hosted multi-reflector antenna system includes coupling a primary reflector via a number of booms and joint structures to an optical bench. The method further includes positioning an anti-jam housing comprising a low coefficient of thermal expansion (CTE) composite structure on the optical bench and coupling a feed structure including an ESA to a first wall of the anti-jam housing. A subreflector is coupled to a second wall of the anti-jam housing opposite the first wall to direct a reflected beam of the primary reflector onto the ESA. The hosted multi-reflector antenna system is mechanically and thermally independent of a host space vehicle, accommodates a thermal dissipation of the feed structure and maintains a precise antenna system alignment.

In yet other aspects, a compact hosted large aperture multi-reflector antenna system includes a primary reflector coupled via a number of booms and joint structures to an optical bench. The antenna system further includes a high-dissipation feed structure including an ESA, a subreflector that directs a reflected beam of the primary reflector onto the ESA, and an anti jam housing consisting of a low CTE composite structure and one or more aluminum radiators. The anti-jam housing encloses the subreflector and the ESA. The antenna system is mechanically and thermally independent of a host space vehicle, and the low CTE composite structure preserves an antenna system alignment by reducing the thermal elastic distortion (TED) resulting from high thermal dissipation of the high-dissipation feed structure.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of this detailed description, which includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

In some aspects of the present technology, methods and configurations are disclosed for providing a hosted multi-reflector antenna system. The hosted multi-reflector antenna system of the subject technology is a compact, east-west (E/W) oriented, and large-aperture antenna system that is deployable with a high-dissipation feed. Accommodation of features such as compactness, E/W orientation and large aperture in a hosted deployable multi-reflector antenna system with a high payload dissipation can be difficult due to a number of challenges. For example, the hosted payload design interdependency with a host space vehicle (e.g., a satellite, also referred to as a "bus") drives cost, complexity and risk. Further, mechanical interfaces may vary depending on the host space vehicle, which can have an unknown bus distortion and an unknown thermal interface. The other challenges include precise alignment, for instance, of a laser inter-satellite link (ISD, a telescope, and so on, and antenna mechanical alignments. Furthermore, integrated thermal designs are difficult to achieve. Such thermal challenges complicate antenna and payload design due to a number of factors such as the high thermal power (e.g., ~250 watts) that can distort antenna optics, electronically steered antennas' (ESAs'), requirement of low temperatures for better performance and longer life, and anti jam housing (faraday cage) that can complicate heat rejection.

The existing antenna systems lack any payload component, such as an ESA, to be easily hosted. In the existing antenna systems, antenna pointing can be degraded by the bus thermal distortions due to lack or insufficiency of thermal management system.

Figure 1:
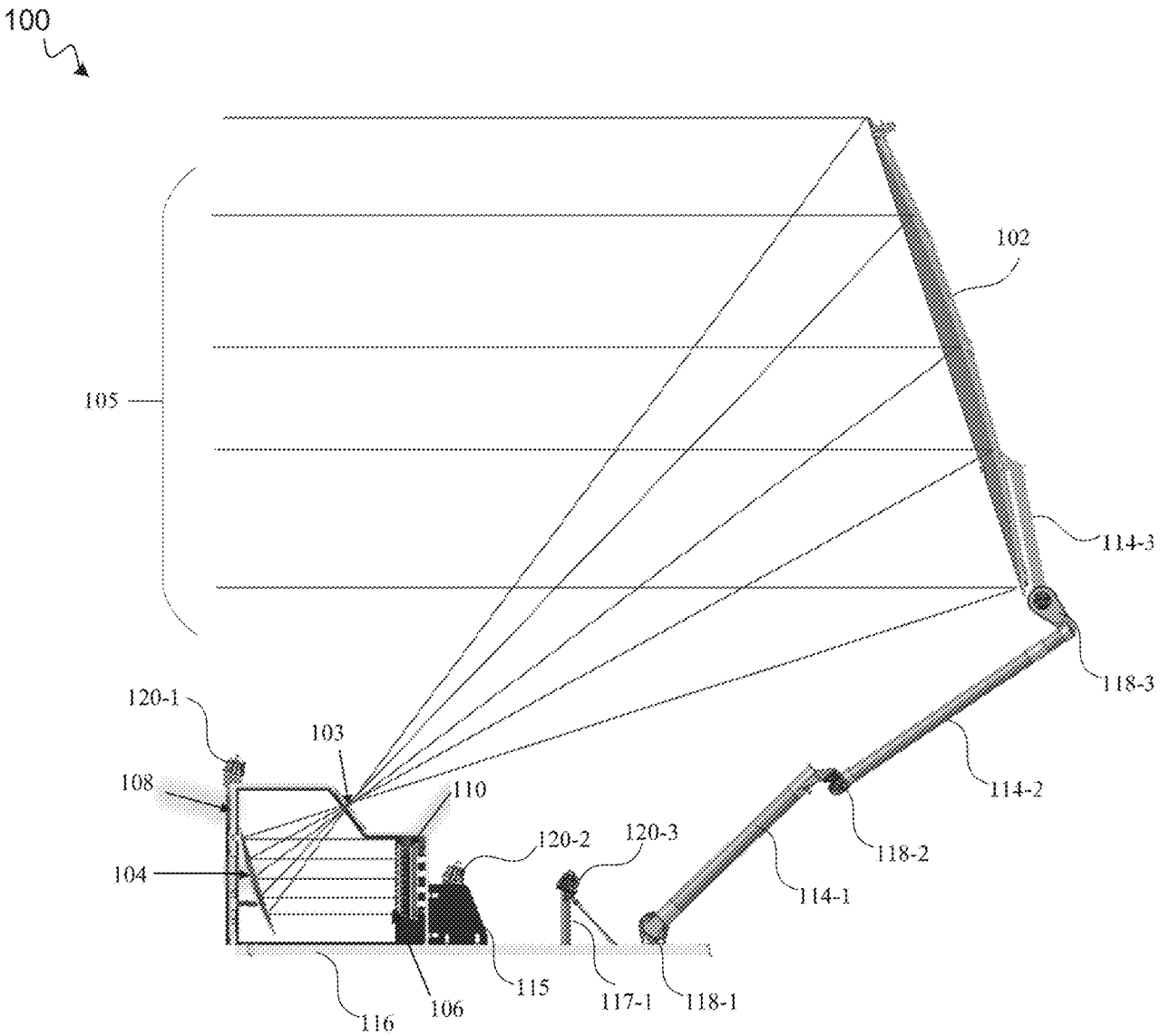
FIG. 1 is a schematic diagram illustrating an example of a hosted multi-reflector antenna system, according to certain aspects of the disclosure.

FIG. 1 is a schematic diagram illustrating an example of a hosted multi-reflector antenna system 100, according to certain aspects of the disclosure. The example hosted multi-reflector antenna system 100 (hereinafter, antenna system 100) is a compact, E/W oriented, and large aperture antenna system that can handle thermal dissipation of a high-dissipation feed (e.g., ~250 watts). The antenna system 100 includes a number of antenna elements such as a primary reflector 102, an aperture (iris) 103, a subreflector 104 and an ESA 106, that is part of a feed structure 110. An anti-jam housing 108 encloses the subreflector 104, the feed structure 110 and the ESA 106.

The primary reflector 102 focuses a beam 105 into the aperture 103 that is also at a focal point of the subreflector 104, which converts the received beam into a parallel beam directed at the ESA 106. The beam 105 is, for example, a communication link between a host space vehicle (e.g., a space vehicle, such as a satellite) and a terrestrial station such as a satellite gateway or user terminal. The antenna system 100 is designed to be mechanically and thermally independent of the host space vehicle so that it can be mounted on different host space vehicle. The antenna system 100 can readily accommodate the thermal dissipation of the feed stricture 110 of a high-dissipation feed, and is able to maintain the precise antenna alignment between the antenna elements such as the primary reflector 102, the subreflector 104, the aperture 103, and the ESA 106, as discussed in more detail herein.

The anti-jam housing 108 includes a composite structure and a thermal radiator layer that enable the antenna system 100 to handle the thermal dissipation of the feed structure 110. The anti-jam housing 108 is mounted on an optical bench 116 that also supports the primary reflector 102 via a reflector-support structure, including a number of (e.g., three) booms 114 (114-1, 114-2 and 114-3) and joint structures 118 (118-1, 118-2 and 118-3). The optical bench 116 is decoupled from the host space vehicle to reduce any thermal elastic distortion (TED) from the host space vehicle so that the alignment between the primary reflector 102 and the subreflector 104 can be preserved and not disturbed by the TED of the host space vehicle. The optical bench further accommodates kinematic mounts (not shown in FIG. 1, for simplicity) that are used to couple the antenna system 100 to the host space vehicle. The system 100 also includes locking fixtures 120 (e.g., 120-1, 120-2, 120-3 and 120-4 (not visible in FIG. 1)), which can lock components of the antenna system 100, when not in use, in a stowed configuration. The locking fixture 120-1 is mounted on the anti jam housing 108 and the locking fixtures 120-2, 120-3 and 120-4 (shown in FIG. 2B) are mounted on the optical bench 116 and a bus panel of the host space vehicle, respectively, via fixtures 115, 117-1, and 117-2 (not visible in FIG. 1).

Figure 2B:
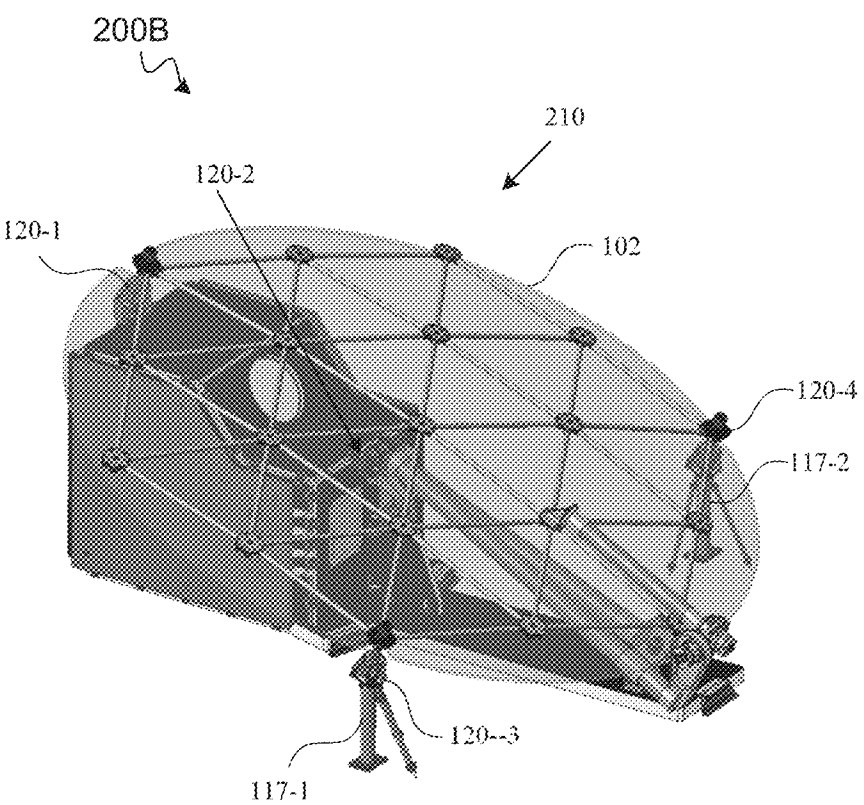
FIG. 2B is a schematic diagram illustrating a perspective view of an example of a hosted multi-reflector antenna system in a stowed configuration, according to certain aspects of the disclosure.
Figure 2A:
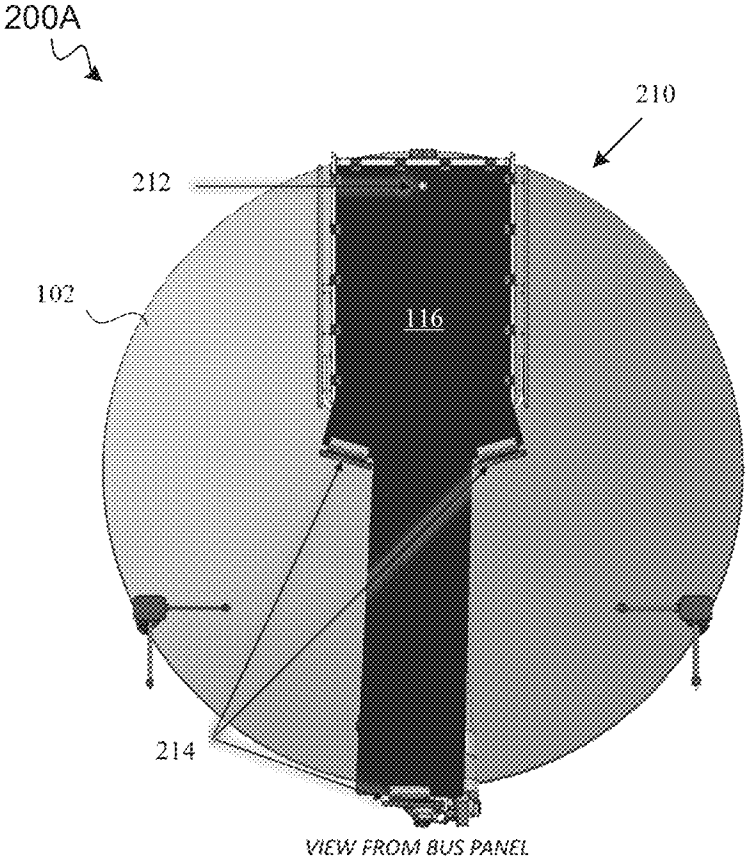
FIG. 2A is a schematic diagram illustrating a view from a bus panel of an example of a hosted multi-reflector antenna system, according to certain aspects of the disclosure.

FIG. 2A is a schematic diagram illustrating a view 200A from a bus panel of an example of a hosted multi-reflector antenna system 210, according to certain aspects of the disclosure. The view 200A shows the hosted multi-reflector antenna system 210 (hereinafter, antenna system 210) from a bus panel of a host space vehicle (i.e. looking outboard from the host space vehicle) and depicts a front view of the primary reflector 102, as it is folded back on to the locking fixtures 120 of FIG. 1, and a back view of the optical bench 116. The antenna system 210 is the same antenna system 100 of FIG. 1 in a folded configuration. Attached to the optical bench 116 are a hard mount 212 and three radial flexures 214 that are used to couple the antenna system 210 to the bus panel of a host space vehicle. The hard-mount 212 and three radial fixtures 214, while attaching the antenna system 210 to the host space vehicle, thermally decouple the antenna system 210 from the host space vehicle so that the TED of the host space vehicle is prevented from affecting the alignment of the antenna system 210.

FIG. 2B is a schematic diagram illustrating a perspective view 200B of an example of a hosted multi-reflector antenna system 210 in a stowed configuration, according to certain aspects of the disclosure. The antenna system 210 is the same antenna system 100 of FIG. 1 in a folded configuration, with the booms 114 folded and locked to the locking fixture 120-2, and the primary reflector 102 is locked to the locking fixtures 120-1, 120-3 and 120-4. The locking fixtures 120-3 and 120-4 are supported by fixtures 117-1 and 117-2, respectively, which is coupled to the bus panel of the host space vehicle. The antenna system in the stowed configuration has a compact volume as shown by the dimensions in FIG. 3 below.

Figure 3:
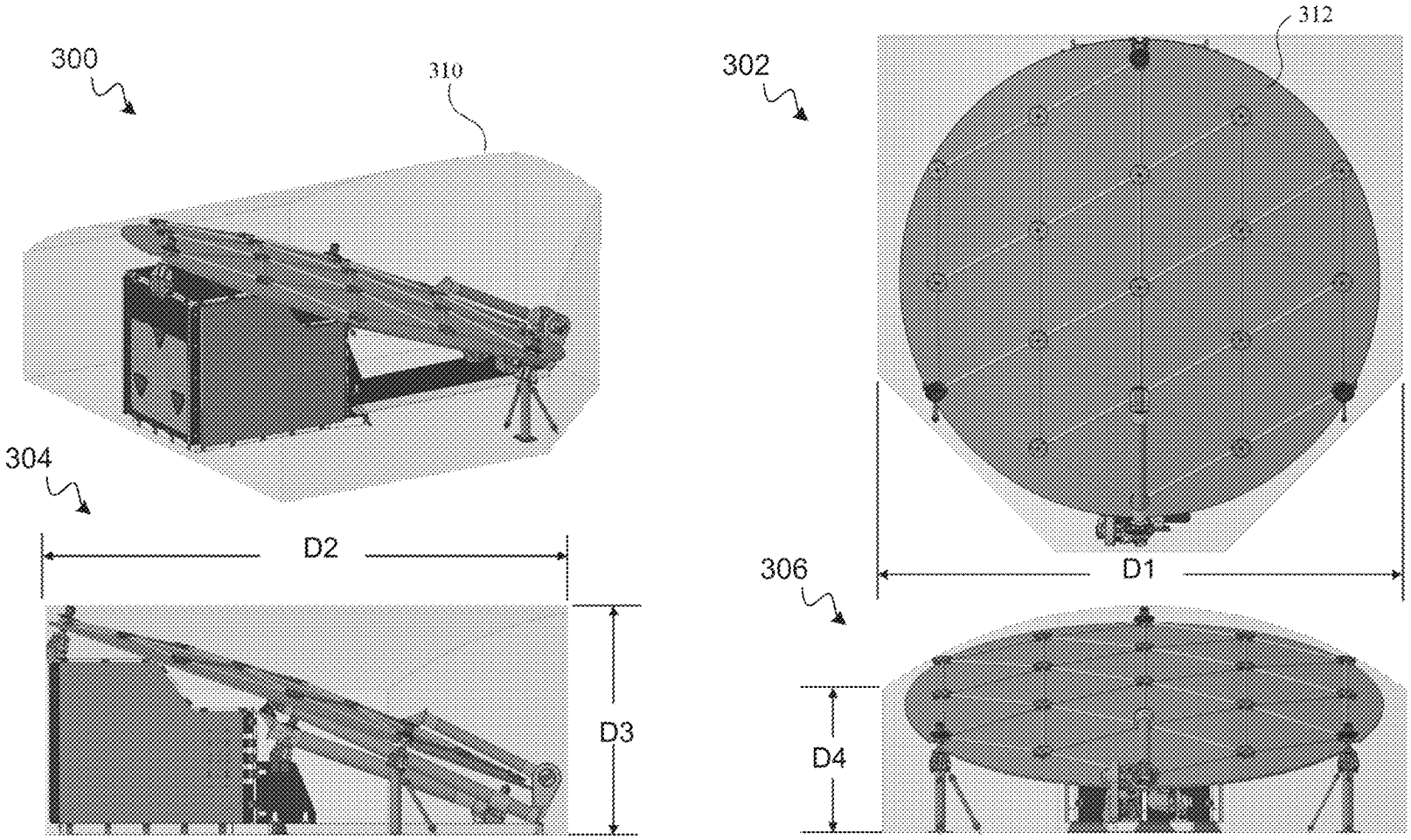
FIG. 3 is a schematic diagram illustrating various views of an example of a hosted multi-reflector antenna system in stowed configuration inside of a compact generic stowed volume, according to certain aspects of the disclosure.

FIG. 3 is a schematic diagram illustrating various views 300, 302, 304 and 306 of an example of a hosted multi-reflector antenna system 310 in a stowed configuration, according to certain aspects of the disclosure. The view 300 shows the compact volume of hosted multi-reflector antenna system 310 (hereinafter, antenna system 310), which is the same as the antenna system 100 of FIG. 1 in a stowed configuration, and clearly depicts folding of the primary reflector.

The view 302 is a top view that shows the antenna system 310 in the stowed configuration and depicts a dimension D1 (e.g., about 104 inches) of the primary reflector 312, which allows an aperture size ranging from 90 to 100 inches for the primary reflector 312.

The view 304 is a side view of the antenna system 310 in the stowed configuration, and depicts dimensions D2 (e.g., about 102 inches) and D3 (e.g., 45 inches) of the antenna system 310.

The view 306 is a side view of the antenna system 310 in the stowed configuration, and depicts dimension D4 (e.g., about 28.5 inches) of the antenna system 310. The dimensions D1, D2, D3 and D4 of the antenna system 310 support the claim of a compact volume in the stowed configuration of the antenna system of the subject technology, which is one of the advantageous features of the disclosed antenna system.

Figure 4:
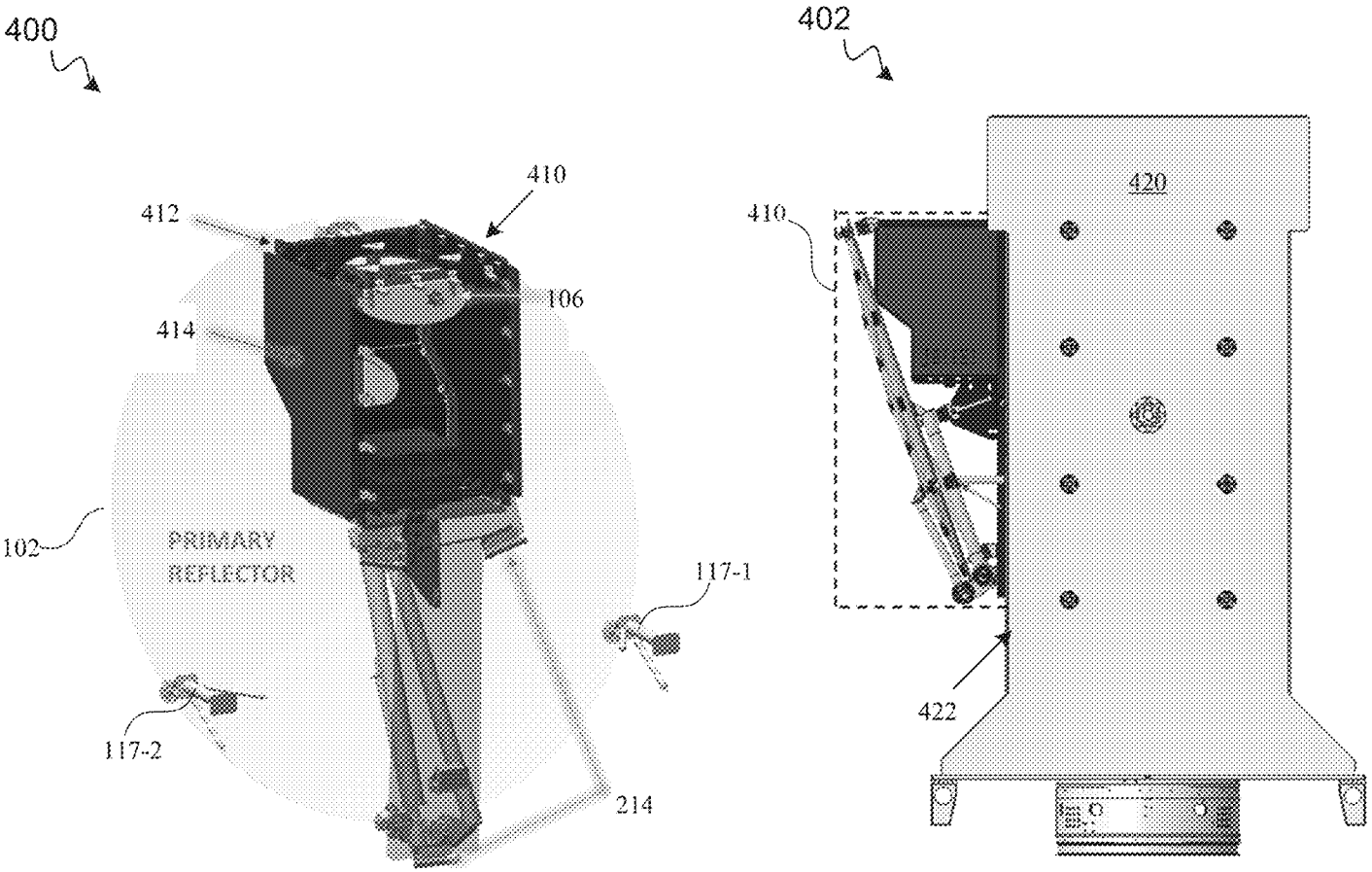
FIG. 4 is a schematic diagram illustrating views of an example of a hosted multi-reflector antenna system in a stowed configuration and isolated from bus distortions, according to certain aspects of the disclosure.

FIG. 4 is a schematic diagram illustrating views 400 and 402 of an example of a hosted multi-reflector antenna system 410 in a stowed configuration and isolated from bus distortions, according to certain aspects of the disclosure. The view 400 shows the hosted multi-reflector antenna system 410 (hereinafter, antenna system 410) in a stowed configuration. The view 400 depicts a low CTE composite structure 412 and a thermal subsystem 414, which include an aluminum radiator, the subreflector 106, the fixtures 117 and radial flexures 214. The low CTE composite structure 412 and the thermal subsystem 414 can accommodate high thermal dissipation of the high-dissipation feed structure 110 of FIG. 1.

The view 402 shows the antenna system 410 in a stowed configuration and coupled (e.g., bolted in) to a host space vehicle (e.g., satellite) 420. The view 402 depicts the antenna system 410, as coupled to a bus panel 422 of the host space vehicle 420 via the fixtures 117, the hard mount 212, and the radial flexures 214, which mechanically and thermally isolate the primary reflector 102 and the optical bench, respectively, from the TED of the host space vehicle 420.

Figure 5:
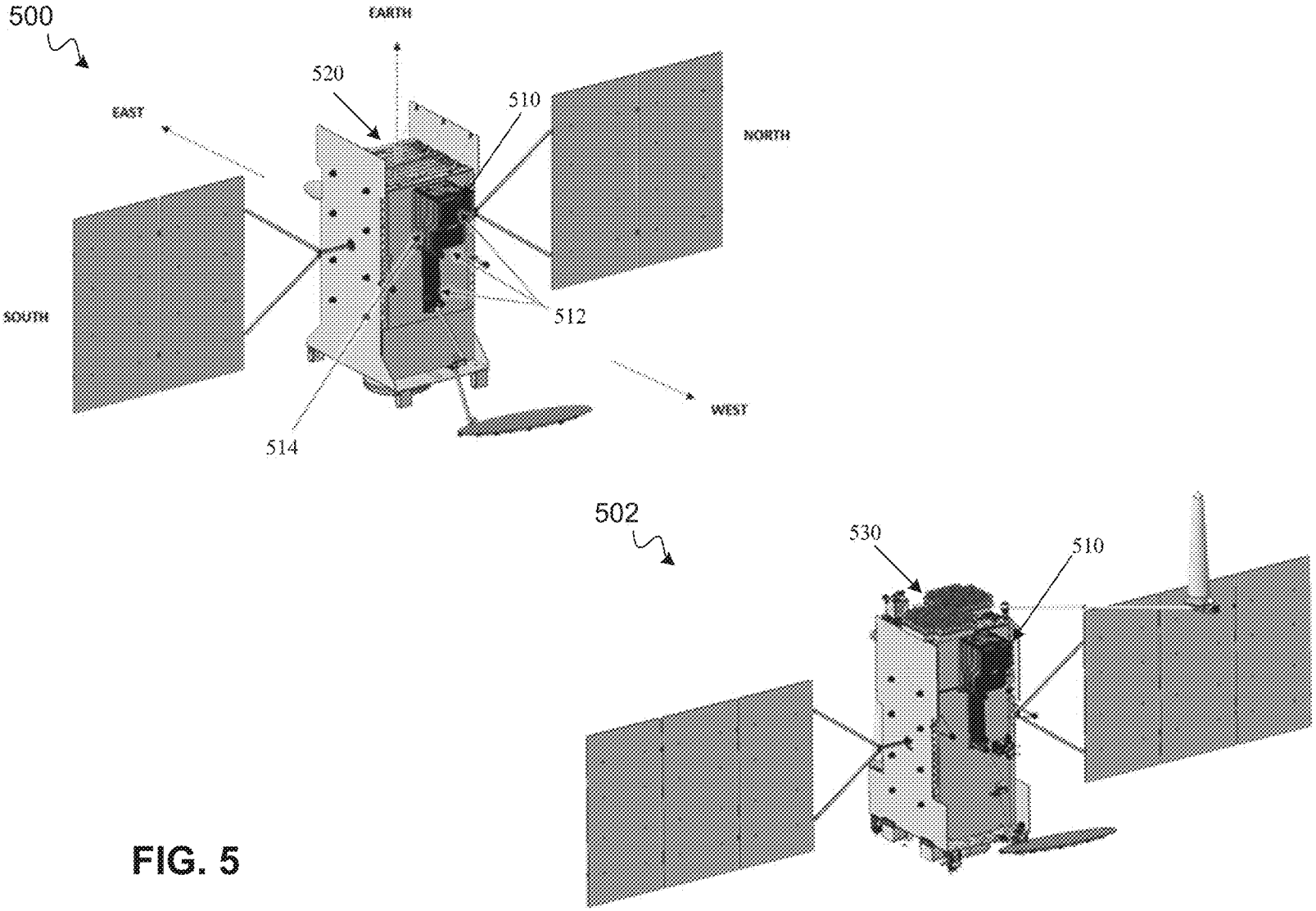
FIG. 5 is a schematic diagram illustrating perspective views of an example of a hosted multi-reflector antenna system of the subject technology hosted on two different satellites.

FIG. 5 is a schematic diagram illustrating perspective views 500 and 502 of an example of a hosted multi-reflector antenna system 510 of the subject technology hosted on two different satellites. In the perspective view 500, the hosted multi-reflector antenna system 510 (hereinafter, antenna system 510) is mounted on a host space vehicle (e.g., satellite) 520. The perspective view 500 also reveals a composite structure 512 that supports an aluminum thermal subsystem (i.e. radiators) 514 of the antenna system 510, which is crucial in eliminating TED and maintaining the alignment of the antenna elements, as described above.

In the perspective view 502, the antenna system 510 is mounted on a host space vehicle (e.g., satellite) 530, which is different from the host space vehicle 520. The antenna system 510 is designed to be mechanically and thermally independent of the host space vehicle so that it can be mounted on different host space vehicles such as the host space vehicles 520 and 530. The antenna system 510 is equipped to readily accommodate the thermal dissipation of a high-dissipation feed and to be able to maintain the precise antenna alignment, as discussed above.

Figure 6:
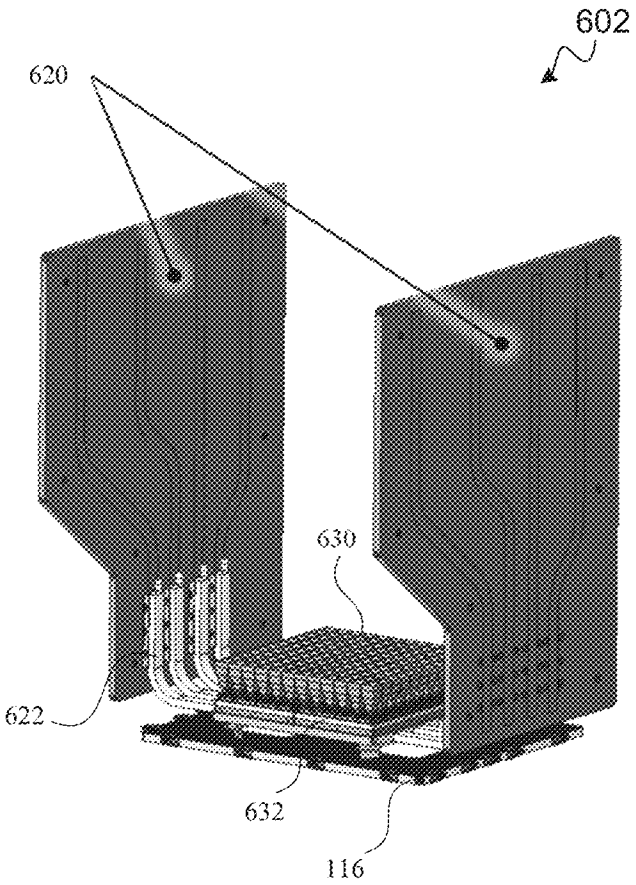
FIG. 6 is a schematic diagram illustrating the structure of an anti-jam housing and a thermal subsystem of an example of a hosted multi-reflector antenna system, according to certain aspects of the disclosure.
Figure 6:
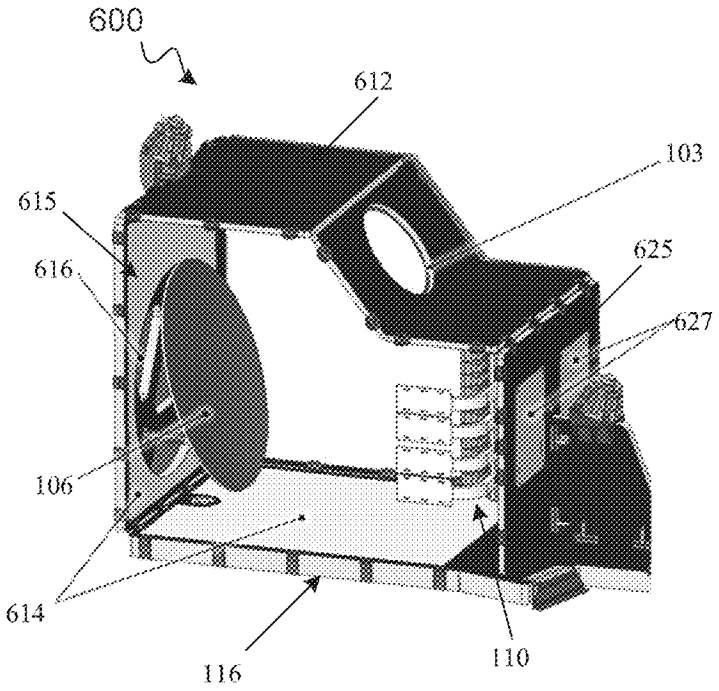

FIG. 6 is a schematic diagram illustrating the structure of an anti-jam housing 600 and a thermal subsystem 602 of an example of a hosted multi-reflector antenna system, according to certain aspects of the disclosure. The anti-jam housing 600 is mounted on the optical bench 116 and includes the aperture 103, the subreflector 106, and a composite structure 612 that supports aluminum thermal radiators 620 and is internally coated with a radio-frequency (RF) absorber 614. The anti-jam housing 600 excludes the feed structure 110. The subreflector 106 is mounted to a first wall 615 of the anti-jam housing 600 via a coupling structure 616. The feed structure 110, including the ESA 630, is kinematically mounted on a wall 625 of the anti-jam housing 600 and the respective ESA mounting access holes are covered via closeout panels 627.

The thermal subsystem 602 includes a thermally conductive ESA mounting plate 632 over which the ESA 630 is mounted, and it is able to transfer high thermal power (e.g., about 250 watts) generated by the ESA 630 to the aluminum thermal radiators 620 via thermally conductive heat pipes 622. The thermal subsystem 602 can dissipate the high thermal power generated by the ESA 630 and excludes wall 625.

Figure 7:
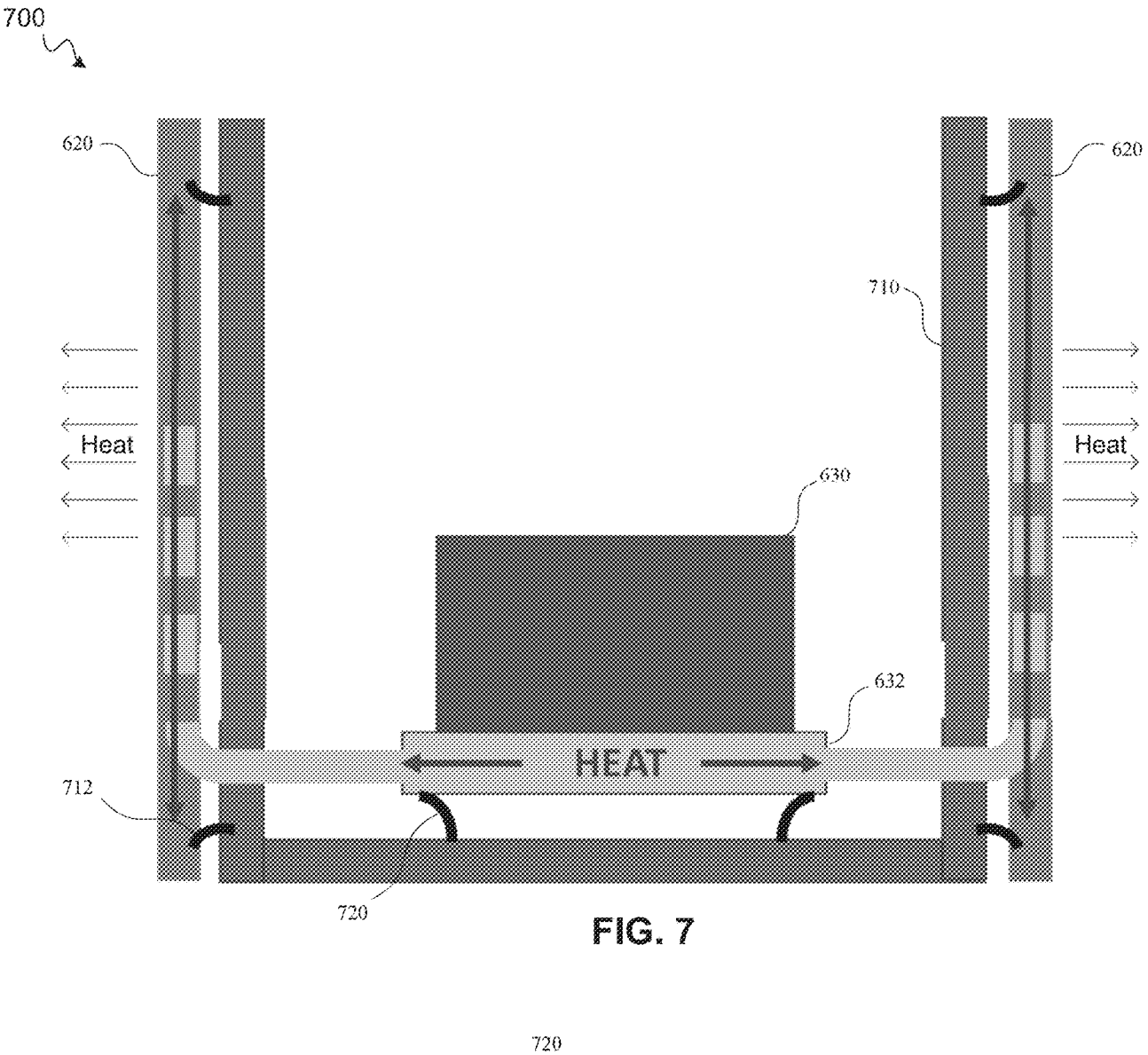
FIG. 7 is a schematic diagram illustrating a heat-dissipation mechanism in a thermal subsystem of an example of a hosted multi-reflector antenna system, according to certain aspects of the disclosure.

FIG. 7 is a schematic diagram illustrating a heat-dissipation mechanism in a thermal subsystem 700 of an example of a hosted multi-reflector antenna system, according to certain aspects of the disclosure. The thermal subsystem 700 includes the thermally conductive ESA mounting plate 632 over which the ESA 630 is mounted and the thermally conductive radiator 620. The heat transferred from the ESA mounting plate 632 flows into the aluminum radiator 620 and dissipates to the environment. The ESA mounting plate 632 and the aluminum radiator 620 are coupled to the composite structure 710 via ESA flexures 720 and radiator flexures 712, respectively.

Figure 8:
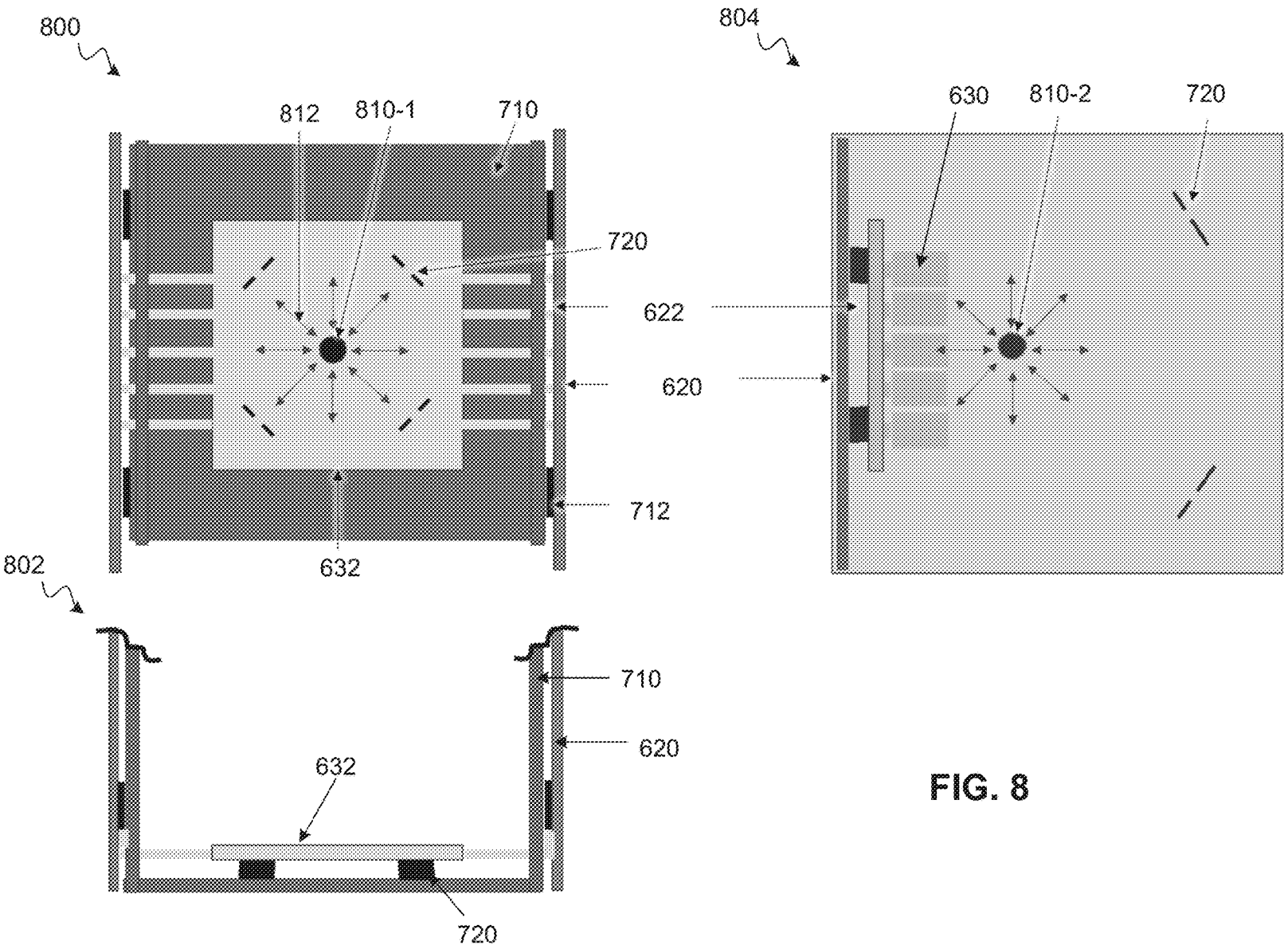
FIG. 8 is a schematic diagram illustrating various views of a heat-dissipation mechanism in a thermal subsystem of an example of a hosted multi-reflector antenna system and the way it is kinematically decoupled from the structural subsystem, according to certain aspects of the disclosure.

FIG. 8 is a schematic diagram illustrating various views 800, 802 and 804 of a heat-dissipation mechanism in the thermal subsystem of an example of a hosted multi-reflector antenna system, according to certain aspects of the disclosure. The view 800 is a top view of the thermal subsystem 700 of FIG. 7 and shows the aluminum ESA mounting plate 632, the composite structure 710, the heat pipes 622, the aluminum radiator 620, an ESA hard-mount 810-1 and ESA flexures 720. The ESA hard-mount 810-1 and the ESA flexures 720 are used to mount the ESA mounting plate 632 on the composite structure 710, while keeping them mechanically decoupled, so that thermal expansion 812 of the aluminum ESA mounting plate 632 is not transferred to the composite structure 710. The front-view 802 is similar to the thermal subsystem 700 of FIG. 7. The side-view 804 shows the ESA 630, the radiator hard-mount 810-2 and the radiator flexures 712.

Figure 9:
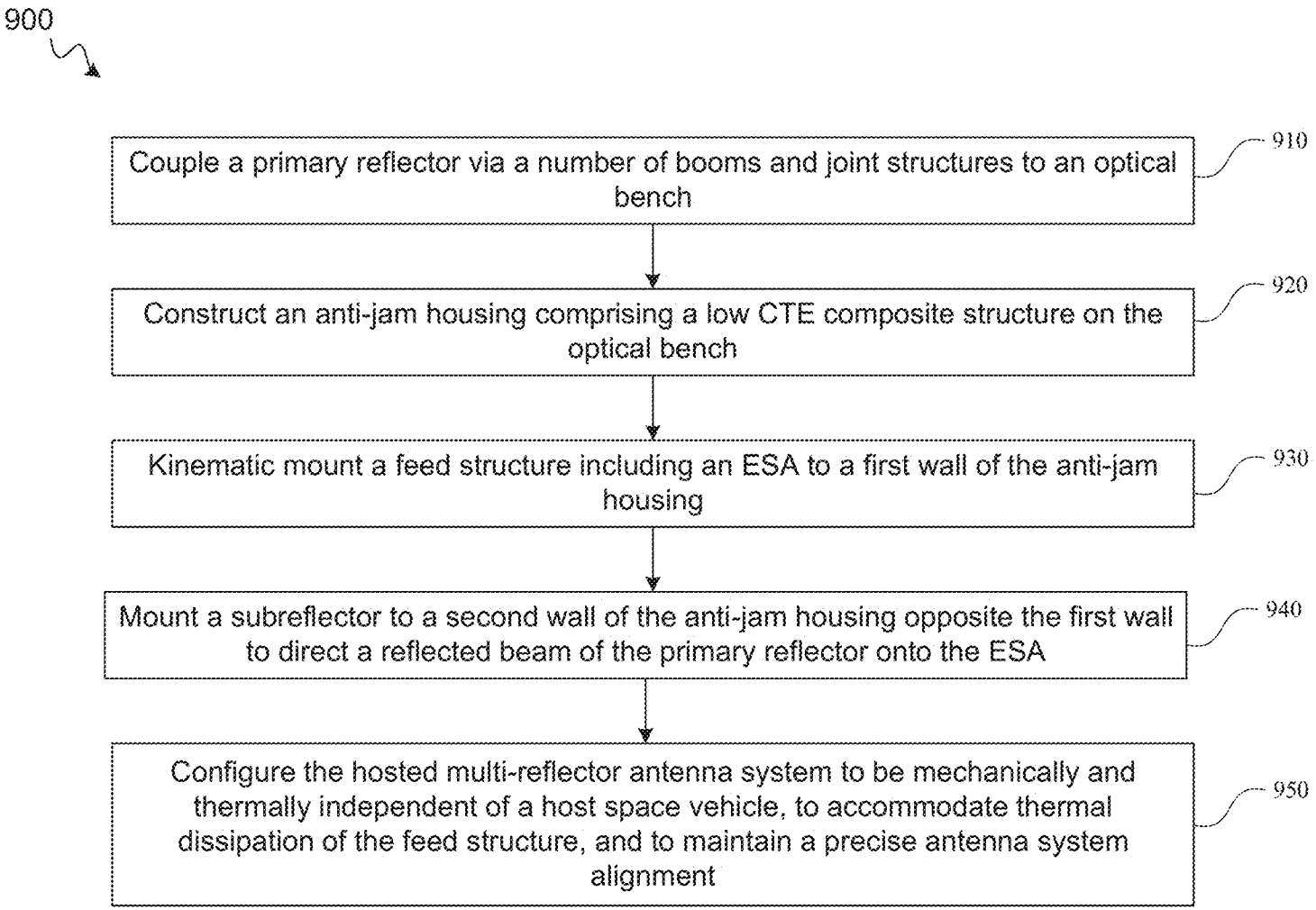
FIG. 9 is a flow diagram illustrating an example of a method of providing a hosted multi-reflector antenna system of the subject technology.

FIG. 9 is a flow diagram illustrating an example of a method 900 of providing a hosted multi-reflector antenna system (e.g., 100 of FIG. 1) of the subject technology. The method 900 includes coupling a primary reflector (e.g., 102 of FIG. 1) via a number of booms (e.g., 114 of FIG. 1) and joint structures (e.g., 118 of FIG. 1) to an optical bench (e.g., 116 of FIG. 1) (910). The method further includes positioning an anti-jam housing (e.g., 108 of FIG. 1) comprising a low CTE composite structure (e.g., 410 of FIG. 4) on the optical bench (920), and coupling a feed structure (e.g., 110 of FIG. 1) including an ESA (e.g., 106 of FIG. 1) to a first wall (e.g., 615 of FIG. 6) of the anti-jam housing (930). A subreflector (e.g., 104 of FIG. 1) is coupled to a second wall (e.g., 625 of FIG. 6) of the anti-jam housing opposite the first wall to direct a reflected beam of the primary reflector onto the ESA (940). The hosted multi-reflector antenna system is configured to be mechanically and thermally independent of a host space vehicle (e.g., 420 of FIG. 4) to accommodate thermal dissipation of the feed structure (e.g., via 632 of FIG. 6) and to maintain a precise antenna system alignment (e.g., alignment of 102, 104 and 106 of FIG. 1) (950).

In some aspects, the subject technology may be used in various markets, including, for example, and without limitation, the satellite systems and communications systems markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified, and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range is specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. An antenna system for a host space vehicle, the antenna system comprising:

a primary reflector;

a feed structure including an electronically steered antenna (ESA);

a subreflector configured to direct a reflected beam of the primary reflector onto the ESA and direct the reflected beam from the ESA to the primary reflector; and an anti-jam housing enclosing the subreflector and the ESA, wherein:

the antenna system is configured to:

be thermo-elastically decoupled and thermally self-sufficient, accommodate a thermal dissipation of the feed structure, and maintain a precise antenna alignment.

2. The antenna system of claim 1, further comprising an optical bench that is kinematically mounted to the host space vehicle and configured to reduce a thermal elastic distortion (TED) from the host space vehicle.

3. The antenna system of claim 2, wherein the optical bench is further configured to accommodate kinematic mounts for coupling the antenna system to the host space vehicle.

4. The antenna system of claim 2, wherein the optical bench is further configured to maintain an alignment between the primary reflector to an aperture of the anti-jam housing.

5. The antenna system of claim 1, wherein the feed structure comprises a high thermal-dissipation feed structure with a thermal power dissipation greater than 250 watts.

6. The antenna system of claim 5, wherein the anti-jam housing comprises composite structure with a low coefficient of thermal expansion (CTE) that is configured to maintain an alignment between the primary reflector, the subreflector and the ESA by reducing TED resulting from a high thermal dissipation of the feed structure.

7. The antenna system of claim 1, wherein the primary reflector is a large-aperture reflector with an aperture size ranging from 90 to 100 inches.

8. The antenna system of claim 7, further comprising a mechanism for extending a vertex of the large-aperture reflector to a distance equal to a focal length of the primary reflector from an aperture of the anti-jam housing.

9. The antenna system of claim 8, wherein the mechanism for extending the vertex of the large-aperture reflector is further configured to fold the antenna system into a compact-volume stowed package when not deployed.

10. The antenna system of claim 1, wherein the anti-jam housing is enclosed in a thermal subsystem made of aluminum.

11. The antenna system of claim 1, further comprising a kinematic mount comprising a hard mount and three radial fixtures to mount the antenna system to the host space vehicle.

12. The antenna system of claim 1, wherein accommodating the thermal dissipation of the feed structure is achieved by using an ESA kinematic restraint and a thermal radiator kinematic restraint.

13. The antenna system of claim 12, wherein the ESA kinematic restraint is configured to decouple ESA thermal expansion from a low CTE composite structure of the anti jam housing while maintaining alignment of the ESA with the subreflector and the primary reflector.

14. The antenna system of claim 12, wherein the thermal radiator kinematic restraint is configured to decouple a thermal expansion of an aluminum radiator from a low CTE composite structure of the anti-jam housing to preserve an antenna system alignment.

15. A method of providing an antenna system for a host space vehicle, the method comprising:

coupling a primary reflector via a number of booms and joint structures to an optical bench;

positioning an anti-jam housing comprising a low CTE composite structure on the optical bench;

coupling a feed structure including an ESA to a first wall of the anti-jam housing;

coupling a subreflector to a second wall of the anti jam housing opposite the first wall to direct a reflected beam of the primary reflector onto the ESA and direct the reflected beam from the ESA to the primary reflector;

configuring the hosted multi-reflector antenna system to:

be thermo-elastically decoupled and thermally self-sufficient from a host space vehicle;

accommodate a thermal dissipation of the feed structure; and maintain a precise antenna system alignment.

16. The method of claim 15, further comprising configuring the optical bench to accommodate kinematic mounts for coupling the antenna system to the host space vehicle and to maintain an alignment between the primary reflector to an aperture of the anti jam housing.

17. The method of claim 15, wherein accommodating the thermal dissipation of the feed structure is achieved by using an ESA kinematic restraint to decouple a thermal expansion of the ESA from the low CTE composite structure while maintaining alignment of the ESA with the subreflector and the primary reflector.

18. The method of claim 15, wherein accommodating the thermal dissipation of the feed structure is achieved by using a thermal radiator kinematic restraint to decouple a thermal expansion of an aluminum radiator of the anti-jam housing from the low CTE composite structure to preserve an antenna system alignment.

19. The method of claim 15, wherein the feed structure comprises a high thermal-dissipation feed structure with a thermal power dissipation greater than 250 watts, and wherein the low CTE composite structure is used to preserve an antenna system alignment by reducing a TED resulting from a high thermal dissipation of the teed structure.

20. An antenna system, comprising:

a primary reflector coupled via a plurality of booms and joint structures to an optical bench;

a high-dissipation feed structure including an ESA;

a subreflector configured to direct a reflected beam of the primary reflector onto the ESA and direct the reflected beam from the ESA to the primary reflector; and an anti jam housing comprising a low CTE composite structure and an aluminum radiator and enclosing the subreflector and the ESA, wherein:

the antenna system is thereto-elastically decoupled and thermally self-sufficient, and the low CTE composite structure is configured to preserve an antenna system alignment by reducing a TED resulting from a high thermal dissipation of the high-dissipation feed structure.

* * * * *